US011770655B2

(12) United States Patent
Song et al.

(10) Patent No.: US 11,770,655 B2
(45) Date of Patent: Sep. 26, 2023

(54) SOUNDING DEVICE

(71) Applicant: AAC Microtech (Changzhou) Co., Ltd., Changzhou (CN)

(72) Inventors: Wei Song, Shenzhen (CN); Xin Jin, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/536,123

(22) Filed: Nov. 29, 2021

(65) Prior Publication Data

US 2022/0174421 A1 Jun. 2, 2022

(30) Foreign Application Priority Data

Nov. 30, 2020 (CN) ..... 202022845272.5

(51) Int. Cl.

| | |
|---|---|
| ***H04R 9/06*** | (2006.01) |
| ***H04R 9/02*** | (2006.01) |
| ***H04R 1/02*** | (2006.01) |
| ***H04R 31/00*** | (2006.01) |

(52) U.S. Cl.

CPC ..... *H04R 9/06* (2013.01); *H04R 1/026* (2013.01); *H04R 9/025* (2013.01); *H04R 31/003* (2013.01)

(58) Field of Classification Search

CPC ..... H04R 9/06; H04R 1/026; H04R 9/025; H04R 31/003; H04R 2499/11; H04R 9/046; H04R 9/02

USPC ..... 381/395, 409, 412, 424

See application file for complete search history.

(56) References Cited

U.S. PATENT DOCUMENTS

| | | | | |
|---|---|---|---|---|
| 2015/0201279 | A1* | 7/2015 | Sprinkle | H04R 1/00 381/162 |
| 2016/0021441 | A1* | 1/2016 | Shao | H04R 1/24 381/412 |
| 2019/0230442 | A1* | 7/2019 | Xiao | H04R 9/046 |
| 2020/0213752 | A1* | 7/2020 | Xiao | H04R 7/12 |
| 2020/0413171 | A1* | 12/2020 | Shen | H04R 9/025 |
| 2020/0413184 | A1* | 12/2020 | Zhang | H05K 1/189 |

* cited by examiner

*Primary Examiner* — Carolyn R Edwards
*Assistant Examiner* — Julie X Dang
(74) *Attorney, Agent, or Firm* — W&G Law Group

(57) ABSTRACT

The present disclosure discloses a sounding device including a frame, a vibration system, and a magnetic circuit system. The vibration system includes a diaphragm, and a voice coil. The magnetic circuit system includes a yoke, a magnet assembly, and a magnetic gap. The yoke includes a bottom wall, a side wall in an annular shape extending from an edge of the bottom wall toward the diaphragm, and a flange extending from an end of the side wall close to the diaphragm toward the frame. An end of the flange away from the side wall is fixed to the frame. Compared with the related art, the sounding device disclosed by the present disclosure has a better reliability.

5 Claims, 4 Drawing Sheets

III–III

SOUNDING DEVICE

FIELD OF THE PRESENT DISCLOSURE

The present disclosure relates to electroacoustic transducers, in particular to a sounding device.

DESCRIPTION OF RELATED ART

With the emergence of the mobile Internet Era, mobile terminal devices are increasing. However, undoubtedly, mobile phones are the most common and portable mobile terminal devices in numerous mobile terminal devices. Sounding devices used to play music and other sounds are widely used in mobile terminal devices such as mobile phones.

A sounding device in the related art includes a frame, a vibration system fixed to the frame, and a magnetic circuit system with a magnetic gap driving the vibration system to vibrate and emit sound. The vibration system includes a diaphragm, and a voice coil received in the magnetic gap for driving the diaphragm to vibrate. The magnetic circuit system includes a yoke fixed to the frame, and a magnet assembly accommodated in the yoke for forming the magnetic gap with the yoke. However, a fixation structure of the yoke and the frame may cause structural interferences between the yoke and other components, while, result in a poor reliability of the sounding device.

Thus, it is necessary to provide a novel sounding device to solve the problem.

SUMMARY

An objective of the present disclosure is to provide a sounding device which has a better reliability.

In order to achieve the objective mentioned above, the present disclosure discloses a sounding device including a frame, a vibration system fixed to the frame, and a magnetic circuit system fixed to the frame for driving the vibration system to vibrate and emit sound. The vibration system includes a diaphragm fixed to the frame, and a voice coil driving the diaphragm to vibrate. The magnetic circuit system includes a yoke, a magnet assembly, and a magnetic gap for receiving the voice coil. The yoke includes a bottom wall, a side wall in an annular shape extending from an edge of the bottom wall toward the diaphragm, and a flange extending from an end of the side wall close to the diaphragm toward the frame. The magnet assembly is fixed to the bottom wall. The magnetic gap is formed by the magnet assembly and the side wall. An end of the flange away from the side wall is fixed to the frame. Compared with the related art, the magnetic circuit system is fixed to the frame through the flange, while, the yoke is completely around the voice coil, and there is no need to provide an avoidance structure in the yoke, thus, the magnetic performance is optimized. Further, a fixation of the flange and the frame ensures a position of the magnetic circuit system in a height direction of the sounding device, and optimizes an internal space of the sounding device so as to avoid structural interferences, thus, the sounding device has a better reliability.

Further, the frame is made of a metal material, and the end of the flange away from the side wall is fixed to the frame by laser welding.

Further, the flange extends along a direction perpendicular to a vibration direction of the diaphragm.

Further, an amount of the flanges is two, and the two flanges respectively extend from two opposite sides of the side wall.

Further, the frame includes a main body, and two notches formed on the main body. The diaphragm is fixed to a top of the main body. Each notch is sunk from a bottom of the main body toward the diaphragm. The two flanges respectively correspond to the two notches. The end of each flange away from the side wall is accommodated in the corresponding notch, and is fixed to a bottom surface of the notch.

Further, the main body is in a rectangular shape and includes two oppositely arranged long axis sides, and two oppositely arranged short axis sides connected with the two long axis sides. The two notches are respectively formed on the two long axis sides. The vibration system further includes a supporting member fixed to a side of the diaphragm close to the magnetic circuit system, and two oppositely arranged auxiliary diaphragm assemblies. The two auxiliary diaphragm assemblies respectively correspond to the two short axis sides. The voice coil is fixed to the supporting member. One end of each auxiliary diaphragm assembly is fixed to a bottom of the corresponding short axis side away from the diaphragm, and another end of each auxiliary diaphragm assembly is fixed to the supporting member.

Further, each auxiliary diaphragm assembly includes a conductively elastic member fixed to the corresponding short axis side, and an auxiliary diaphragm attached to a side of the conductively elastic member away from the diaphragm.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure.

DETAILED DESCRIPTION OF THE EMBODIMENTS

Figure 1:
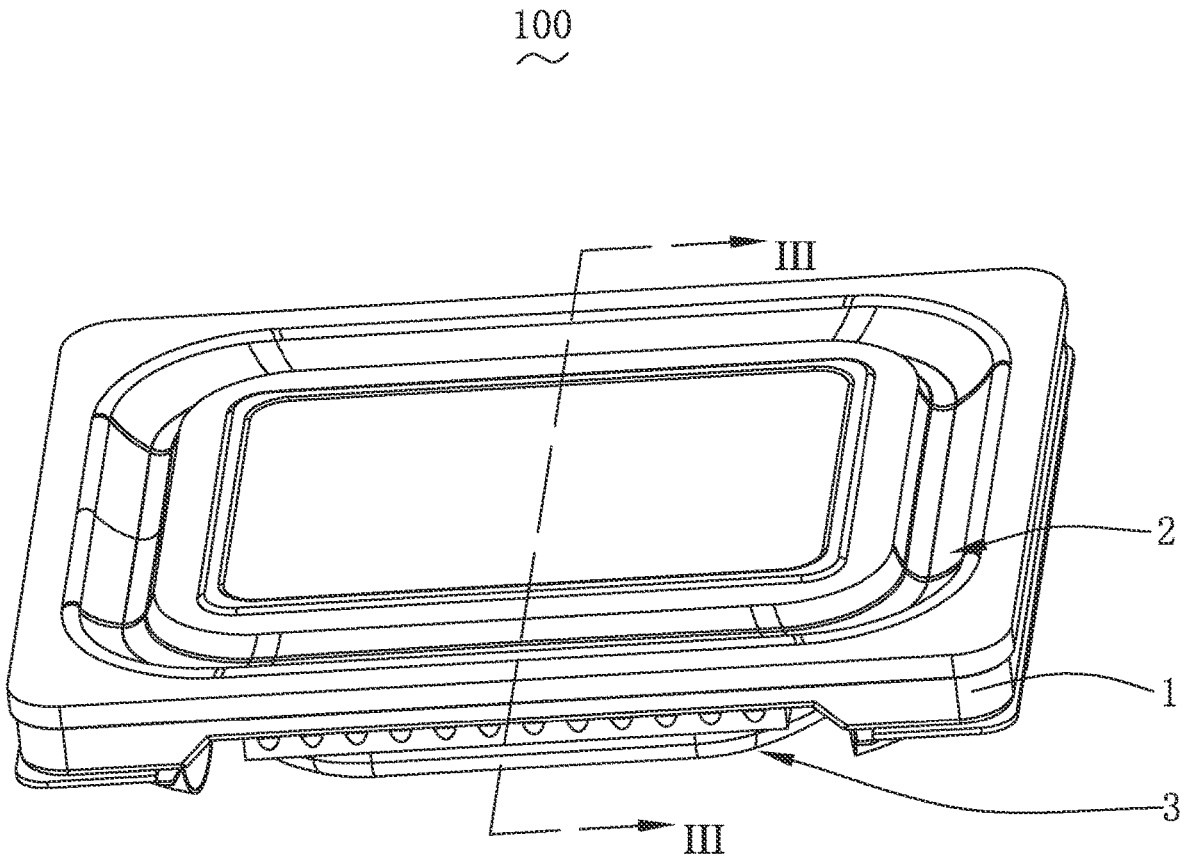
FIG. 1 is an isometric view of a sounding device in accordance with an exemplary embodiment of the present disclosure.
Figure 2:
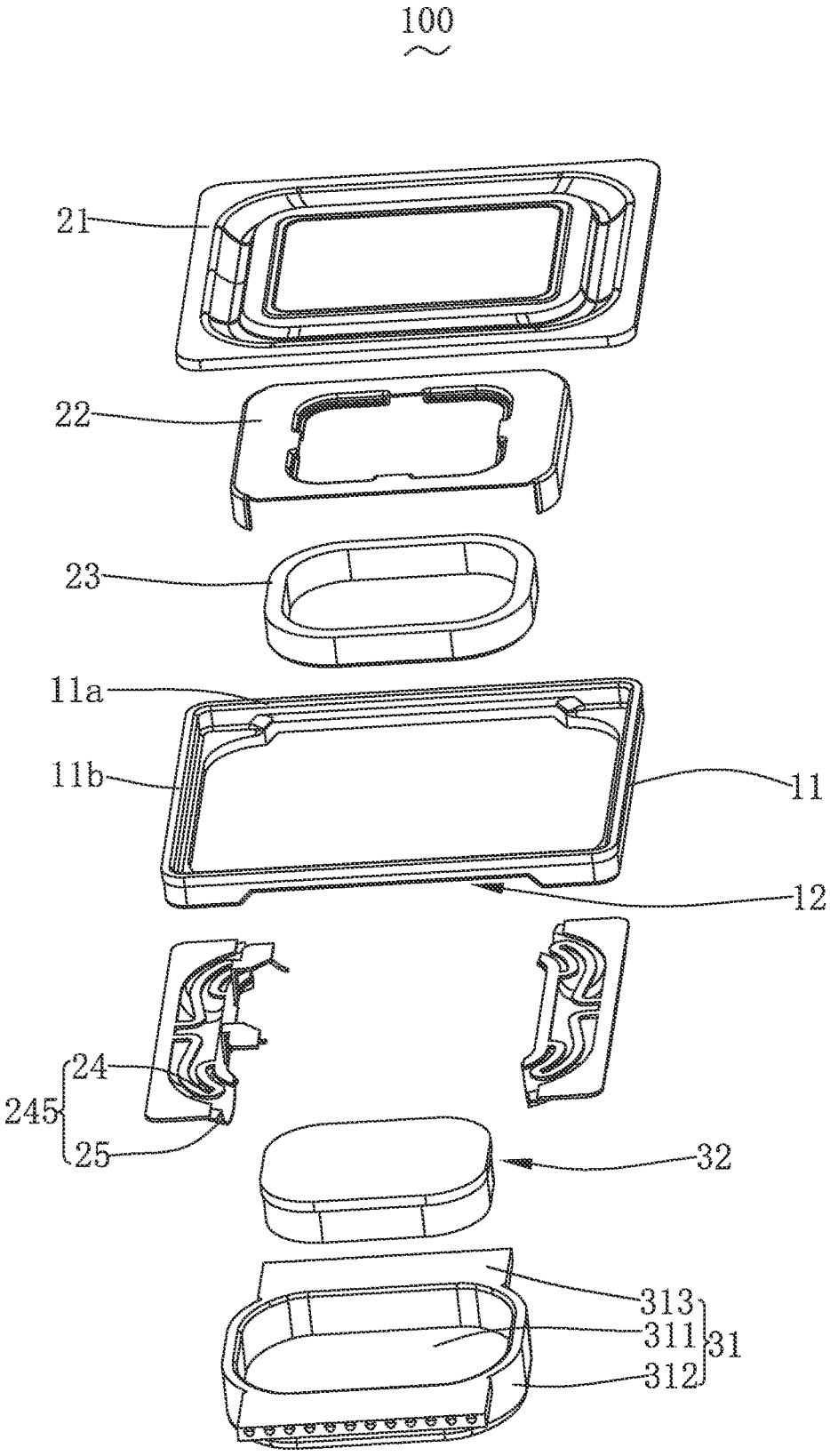
FIG. 2 is an exploded view of the sounding device in FIG. 1.
Figure 3:
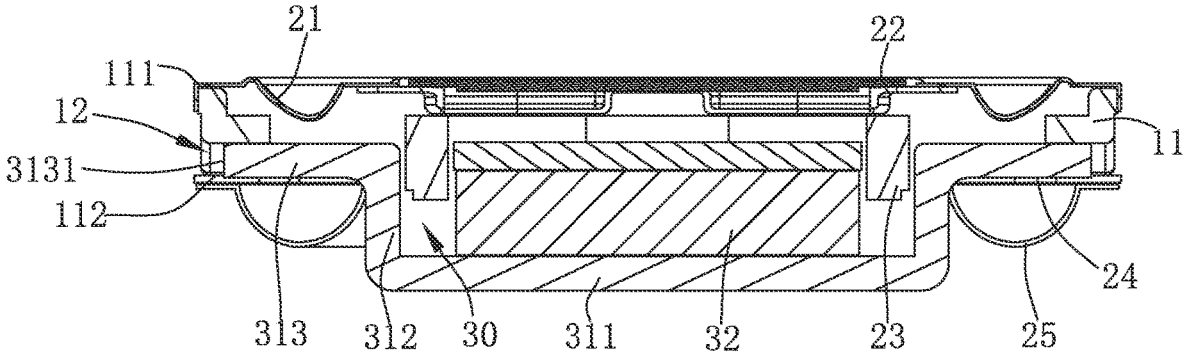
FIG. 3 is a cross-sectional view of the sounding device taken along line III-III in FIG. 1.

The present disclosure will hereinafter be described in detail with reference to the embodiments. To make the technical problems to be solved, and technical solutions and beneficial effects of the present disclosure more apparent, the present disclosure is described in further detail together with the figures and the embodiments. It should be understood the embodiments described hereby are only to explain the disclosure, not intended to limit the disclosure.

Referring to FIGS. 1-4, the present disclosure discloses a sounding device 100 including a frame 1, a vibration system 2 fixed to the frame 1, and a magnetic circuit system 3 fixed to the frame 1 for driving the vibration system 2 to vibrate and emit sound.

The vibration system 2 includes a diaphragm 21 fixed to the frame 1, and a voice coil 23 driving the diaphragm 21 to vibrate.

The magnetic circuit system 3 includes a yoke 31, a magnet assembly 32, and a magnetic gap 30 for receiving the voice coil 23. The yoke 31 includes a bottom wall 311, a side wall 312 in an annular shape extending from an edge of the bottom wall 311 toward the diaphragm 21, and a flange 313 extending from an end of the side wall 312 close to the diaphragm 21 toward the frame 1. Optionally, the flange 313 extends along a direction perpendicular to a vibration direction of the diaphragm 21. The magnet assembly 32 is fixed to the bottom wall 311. The magnetic gap 30 is formed by the magnet assembly 32 and the side wall 312. An end 3131 of the flange 313 away from the side wall 312 is fixed to the frame 1. The magnetic circuit system 3 is fixed to the frame 1 through the flange 313, while, the yoke 31 is completely around the voice coil 23, and there is no need to provide an avoidance structure in the yoke 31, thus, the magnetic performance is optimized. Further, a fixation of the flange 313 and the frame 1 ensures a position of the magnetic circuit system 3 in a height direction of the sounding device 100, and optimizes an internal space of the sounding device 100 so as to avoid structural interferences, thus, the sounding device 100 has a better reliability.

Optionally, an amount of the flanges 313 is two, the two flanges 313 respectively extend from two opposite sides of the side wall 312.

Figure 4:
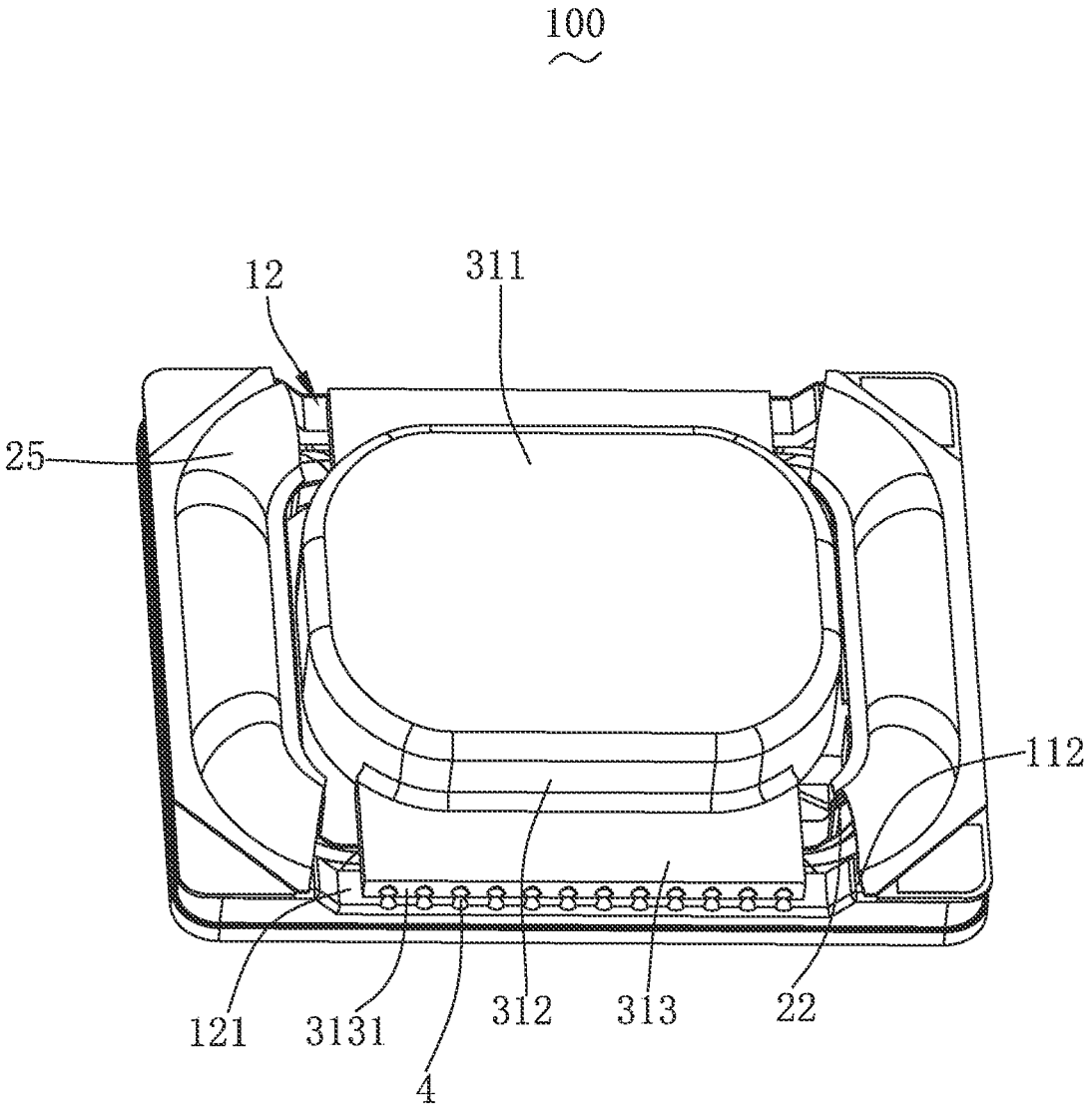
FIG. 4 is an isometric view of the sounding device in FIG. 1, from another aspect.

Optionally, the frame 1 is made of a metal material and includes a main body 11, and two notches 12 formed on the main body 11. The diaphragm 21 is fixed to a top 111 of the main body 11. The main body 11 is in a rectangular shape and includes two oppositely arranged long axis sides 11*a*, and two oppositely arranged short axis sides 11*b* connected with the two long axis sides 11*a*. Optionally, the two notches 12 are respectively formed on the two long axis sides 11*a*. The two flanges 313 respectively correspond to the two notches 12. Each notch 12 is sunk from a bottom 112 of the main body 11 toward the diaphragm 21. The end 3131 of each flange 313 away from the side wall 312 is accommodated in the corresponding notch 12, and is fixed to a bottom surface 121 of the notch 12 by laser welding. Referring to FIG. 4, a plurality of welding spots 4 is formed at the junction of the flange 313 and the frame 1 after laser welding.

Optionally, the vibration system 2 further includes a supporting member 22 fixed to a side of the diaphragm 21 close to the magnetic circuit system 3, and two oppositely arranged auxiliary diaphragm assemblies 245. One end of the voice coil 23 is fixed to the supporting member 22, and another end of the voice coil 23 locates in the magnetic gap 30. The two auxiliary diaphragm assemblies 245 respectively correspond to the two short axis sides 11*b* of the main body 11. One end of each auxiliary diaphragm assembly 245 is fixed to the bottom 112 of the corresponding short axis side 11*b* away from the diaphragm 21, and another end of each auxiliary diaphragm assembly 245 is fixed to the supporting member 22. The supporting member 22 can adjust a position of the voice coil 23 in the magnetic gap 30 and couple the diaphragm 21 and the auxiliary diaphragm assembly 245. The auxiliary diaphragm assembly 245 can support the voice coil 23 to vibrate stably.

Optionally, each auxiliary diaphragm assembly 245 includes a conductively elastic member 24 fixed to the corresponding short axis side 11*b*, and an auxiliary diaphragm 25 attached to a side of the conductively elastic member 24 away from the diaphragm 21. The conductively elastic member 24 is used to electrically connect the voice coil 23 and an external circuit.

Compared with the related art, the magnetic circuit system 3 is fixed to the frame 1 through the flange 313, while, the yoke 31 is completely around the voice coil 23, and there is no need to provide an avoidance structure in the yoke 31, thus, the magnetic performance is optimized. Further, a fixation of the flange 313 and the frame 1 ensures a position of the magnetic circuit system 3 in a height direction of the sounding device 100, and optimizes an internal space of the sounding device 100 so as to avoid structural interferences, thus, the sounding device 100 has a better reliability.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms where the appended claims are expressed.

What is claimed is:

1. A sounding device, comprising:

a frame, comprising a main body and two notches formed on the main body;

a vibration system fixed to the frame, comprising a diaphragm fixed to, a top of the main body and a voice coil driving the diaphragm to vibrate, each notch sunk from a bottom of the main body toward the diaphragm; and a magnetic circuit system fixed to the frame for driving the vibration system to vibrate and emit sound, comprising:

a yoke, comprising a bottom wall, a side wall in an annular shape extending from an edge of the bottom wall toward the diaphragm, and two flanges respectively corresponding to the two notches and extending from ends of two opposite sides of the side wall close to the diaphragm toward the frame, wherein, an end of each flange away from the side wall is accommodated in one corresponding notch and is fixed to a bottom surface of the corresponding notch;

a magnet assembly fixed to the bottom wall; and a magnetic gap formed by the magnet assembly and the side wall for receiving the voice coil.

2. The sounding device as described in claim 1, wherein the frame is made of a metal material, the ends of the two flanges away from the side wall is fixed to the frame by laser welding.

3. The sounding device as described in claim 1, wherein the two flanges extend along a direction perpendicular to a vibration direction of the diaphragm.

4. The sounding device as described in claim 1, wherein the main body is in a rectangular shape and comprises two oppositely arranged long axis sides, and two oppositely arranged short axis sides connected with the two long axis sides, the two notches are respectively formed on the two long axis sides, the vibration system further comprises a supporting member fixed to a side of the diaphragm close to the magnetic circuit system, and two oppositely arranged auxiliary diaphragm assemblies, the two auxiliary diaphragm assemblies respectively correspond to the two short axis sides, the voice coil is fixed to the supporting member, one end of each auxiliary diaphragm assembly is fixed to a bottom of the corresponding short axis side away from the diaphragm, and another end of each auxiliary diaphragm assembly is fixed to the supporting member.

5. The sounding device as described in claim 4, wherein each auxiliary diaphragm assembly comprises a conductively elastic member fixed to the corresponding short axis side, and an auxiliary diaphragm attached to a side of the conductively elastic member away from the diaphragm.

* * * * *